United States Patent [19]

Yang

[11] Patent Number: 4,829,722

[45] Date of Patent: May 16, 1989

[54] LIGHT ACCESSORY FOR A BENCH GRINDER

[76] Inventor: Tai-Her Yang, 5-1 Taipin St., Si-Hu Town, Dzan-Hwa, Taiwan

[21] Appl. No.: 201,970

[22] Filed: Jun. 3, 1988

[51] Int. Cl.[4] ..... B24B 55/04

[52] U.S. Cl. ..... 51/268

[58] Field of Search ..... 51/262 R, 268, 272

[56] References Cited

U.S. PATENT DOCUMENTS 1,375,303 4/1921 Leiman ..... 51/268

2,267,189 12/1941 Brown ..... 51/272

*Primary Examiner*—Roscoe V. Parker

*Attorney, Agent, or Firm*—Leonard Bloom

[57] ABSTRACT

A light accessory which may be secured to an existing bench grinder is disclosed which casts its light downwardly towards the work being performed and away from the eyes of the user. Bench grinders are also disclosed which incorporate the light assembly therein as part thereof. In a preferred embodiment, the assembly includes a cover plate which is secured to the annular guard of a bench grinder substantially above the opening whereat work is performed. A mounting bracket is secured at a mounting arm thereof to the cover plate. The mounting bracket has a bracket portion formed at an end thereof and extending therefrom. This bracket portion has an opening formed therein which receives a light bulb receptacle that carries a light bulb. Formed thusly, when the cover plate is positioned on the annular guard, the bulb is held between the cover plate and the guard so that its light is cast downwardly towards the work being performed and away from the eyes of the user. Finally, means including a power source and an electrical cable which is secured between the receptacle and the power source is provided for electrically connecting the receptacle to a power source.

24 Claims, 3 Drawing Sheets

LIGHT ACCESSORY FOR A BENCH GRINDER

FIELD OF THE INVENTION

The present invention relates to light accessories and, in particular, to light accessories for bench grinders.

BACKGROUND OF THE INVENTION

Traditional light accessories for bench grinders are little more than simply additional light fixtures, which are normally secured to the back of the grinder and above the grinding wheel plus the power source for light. Generally, while these light accessories are helpful, their light beam is often too far from the workpiece and/or there frequently is insufficient illumination. Also, by being spaced so far from the bench grinder, and the work being done, glare from the light can often get in the user's eyes. Such placement of the light accessory then can interfere with the use of the device and with the accuracy and safety of the operator.

Additionally, such traditional light accessories as those described above, are often powered by batteries or some other portable power source and are controlled by a separate switch which is independent from the switch of the bench grinder itself. Such an arrangement increases the bulk and manufacturing costs of the lighting accessory.

Therefore, it can be seen that there remains a need for a streamlined light accessory for a bench grinder or similar work tool, which is lightweight, simple in construction, easy to install on even present bench grinders and which accurately directs the light away from the eyes of the user and onto the piece being worked.

SUMMARY OF THE INVENTION

Accordingly, it is a primary object of the present invention to provide a streamlined light accessory for a bench grinder which is lightweight, simple in construction, easy to install and which accurately directs the light away from the eyes of the user.

It is a second object of the present invention to provide a combined lighting, mounting and shielding apparatus which is streamlined having a low silhouette, which requires little metal work and which is easily installed on existing bench grinders and other work tools.

It is a third object of the present invention to provide such a lighting and shielding apparatus which can be directly secured to a traditional bench grinder of the type having a work access opening, such that the light shines directly into the opening and away from the eyes of the user.

In accordance with the teachings of the present invention, a streamlined light accessory is disclosed. This accessory is for use on a bench grinder of the type having a motor-driven grinding wheel and an annular guard for the wheel. The guard has a top portion. An arcuate opening is formed in the guard providing access to the wheel. A tool rest is positioned on the guard for supporting the work being applied to the wheel.

The light accessory includes a cover plate. Means is provided for securing the cover plate to the top portion of the guard substantially above the arcuate opening formed in the guard. A light bulb receptacle is provided with means for mounting the receptacle. In this manner, the receptacle is maintained between the guard and the cover plate. A light bulb is carried by the receptacle, wherein the light bulb casts its light rays downwardly towards the tool rest and away from the eyes of the user of the bench grinder; finally, means is provided for electrically connecting the light bulb receptacle to a power source.

Preferably, the means for carrying the receptacle, such that the receptacle is maintained between the guard and the cover plate, a mounting bracket that is secured between the cover plate and the top portion of the guard. This mounting bracket includes a mounting arm which is secured to the cover plate. This mounting arm has a first end having a bracket portion formed thereon and extending therefrom. The bracket portion has an opening formed therein for receiving and holding the light bulb receptacle therein. It is further preferred that the light bulb receptacle have a rearward threaded portion and that an internally threaded nut be provided for threadably engaging the rearward threaded portion of the light bulb receptacle. In this fashion, when the receptacle is disposed through the opening formed in the bracket portion, the nut may be removably received thereon for removably securing the receptacle to the mounting bracket.

If desired, the light accessory may be incorporated as part of a bench grinder itself. In this respect there is disclosed a bench grinder having a motor-driven grinding wheel.

An annular guard is provided for the grinding wheel. The annular guard has a top portion. The annular guard further has an arcuate opening formed therein which provides access to the wheel. A tool rest is positioned on the guard for supporting the work being applied to the wheel. A cover plate is secured to the top portion of the guard substantially above the arcuate opening in the guard. A mounting bracket is secured between the cover plate and the top portion of the guard. A light bulb receptacle is carried by the mounting bracket and a light bulb is carried by the receptacle.

Means is provided which includes a power source and an electrical cable. The cable secured between the receptacle and the power source. In this manner, the bulb carried by the receptacle is electrically connected to the power source. Positioned thusly, the light bulb achieves its objective by casting its light rays downwardly towards the tool rest and away from the eyes of the user of the bench grinder.

Alternatively, another bench grinder is disclosed which has a motor-driven grinding wheel. An annular guard is provided for the grinding wheel. This annular guard is positioned about the grinding wheel, defining a clearance space therebetween. The annular guard has a top portion. The annular guard further has an arcuate opening formed therein which provides access to the wheel. The top portion includes a substantially downwardly and outwardly-inclined portion that terminates at the opening of the guard. A tool rest is positioned on the guard for supporting the work being applied to the wheel. A downwardly-inclined shield plate is secured to the guard extending into the space between the downwardly and outwardly-inclined portion of the guard. In this fashion, a pocket is defined therebetween. A mounting bracket is secured between the shield plate and the top portion of the guard. A light bulb receptacle is carried by the mounting bracket and a light bulb is carried by the receptacle.

The light bulb receptacle having the light bulb therein is received in the pocket, whereby the light carried by the light bulb receptacle is provided with a chip and spark shielding. Means, is provided that includes a power source and an electrical cable secured between the receptacle and the power source, whereby the bulb carried by the receptacle is electrically connected to the power source. The portion of the annular guard and the shield plate are so positioned in forming the pocket in which the light bulb is mounted, that light rays from the light bulb are limited to an angle of approximately 90° and directed downwardly towards the tool rest and away from the eyes of the user of the bench grinder.

In a final teaching of the present invention, there is disclosed an improvement on a bench grinder of the type having a motor-driven grinding wheel and an annular guard for the wheel. The guard has a top portion and an arcuate opening which provides access to the wheel and a tool rest is disposed on the guard for supporting the work being applied to the wheel. The improvement there upon includes the combination of a cover plate that is secured to the top portion of the guard substantially above the arcuate opening in the guard. A mounting bracket that is secured between the cover plate and the top portion of the guard. A mounting bracket that is secured between the cover plate and the top portion of the guard. A light bulb receptacle that is carried by the mounting bracket. The cover plate having an opening formed therein, means including a cable passing through the opening in the cover plate, is provided for electrical connection to the light bulb receptacle, finally, a light bulb is carried by the receptacle. In this fashion, the light bulb casts its light rays downwardly towards the tool rest and away from the eyes of the user of the bench grinder.

These and other objects of the present invention will become apparent from a reading of the following specification, taken in conjunction with the enclosed drawings.

DESCRIPTION OF PREFERRED EMBODIMENTS

Figure 1:
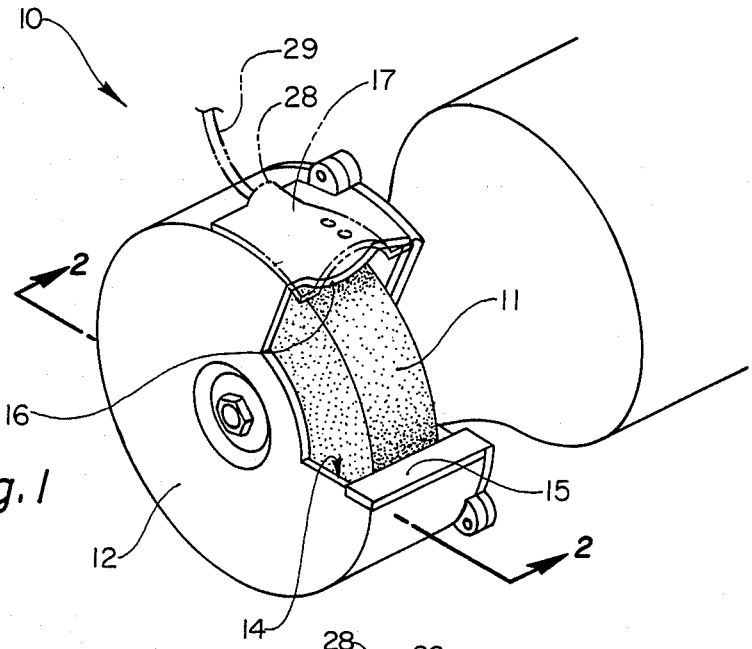
FIG. 1 is a perspective view of a bench grinder having the lighting accessory of the present invention.

Referring now to the drawings, the bench grinder 10 is of the type having a motor driven grinding wheel 11. An annular guard 12 is disposed annularly about the grinding wheel 11, such that a space (a clearance space) 13 is defined therebetween. Annular guard 12 includes a top portion. An arcuate opening 14 is formed in the annular guard 12, thereby providing access to the wheel 11. Finally, a tool rest 15 is positioned on the guard 12 at the opening 14 for receiving and supporting the work (a workpiece) being applied to the wheel 11.

Figure 2:
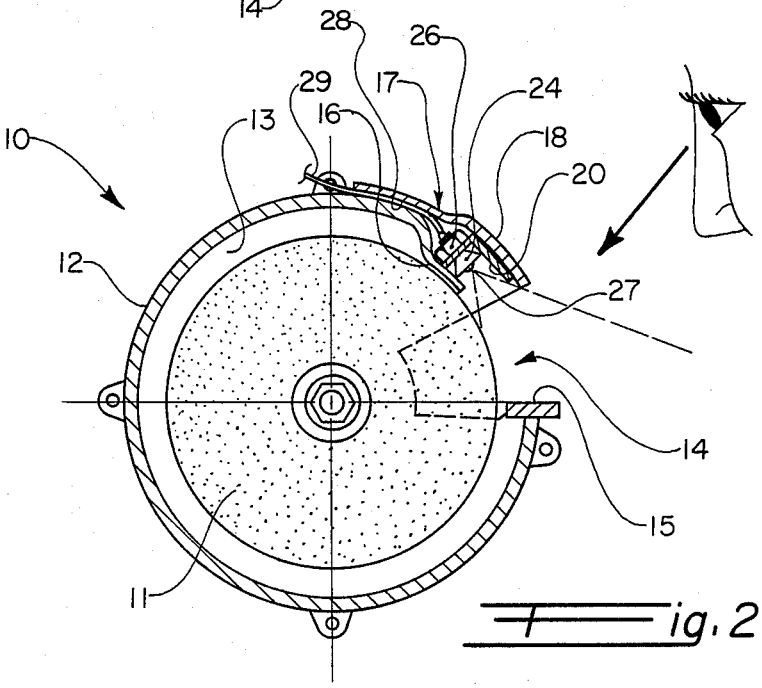
FIG. 2 is a cross-section view taken along lines 2—2 of FIG. 1.

With particular reference now to FIGS. 1 and 2, the guard 12 includes a downwardly-inclined portion 16. Portion 16 is formed in the guard 12 substantially above the arcuate opening 14, terminating at said opening 14. Preferably, said downwardly-inclined portion 16 is substantially arcuate in shape.

Secured to the top portion of the guard 12, substantially above the arcuate opening 14 is a substantially arcuately-shaped cover plate 17. The plate 17 can be secured to the guard by welding, nuts and bolts, or any other suitable means well known to those skilled in the art. Positioned thusly, the cover plate 17 extends over the downwardly inclined portion 16, defining a pocket therebetween and terminating over the opening 14. It is noted that that portion of the cover plate 17 which extends over the opening 14 defines a shield portion 18, whereby a chip and spark shield is provided to the user.

Figure 3:
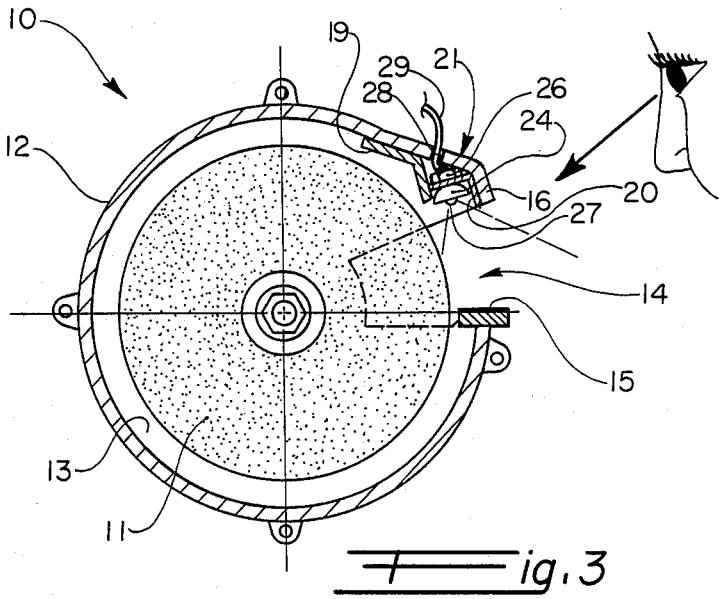
FIG. 3 is a cross-section view of another embodiment of a bench grinder including a lighting accessory of the present invention.

With particular reference now to FIG. 3, the downwardly inclined portion 16 is, alternatively, seen to be also outwardly-inclined. This downwardly and outwardly inclined portion 16 is also formed substantially above the arcuate opening 14, terminating at said opening 14. Portion 16 includes a forwardmost downwardly extending flange portion. This portion serves (like the shield portion 18 of FIGS. 1 and 2) as a shield portion to further shield the eyes of the user from chips and sparks that may occur during working as well as from the rays of the light bulb. Secured to the top portion of the guard 12 is a substantially arcuate shield plate 19. This plate 19 can be secured to the guard 12 by welding, nuts and bolts, or any other suitable means well known to those skilled in the art. Positioned thusly, this shield plate 19 extends into the space between the downwardly and outwardly-inclined portion 16 and the wheel 11, defining a pocket therebetween. As will be discussed herein, when the light bulb receptacle having the light bulb therein is received in the pocket, the plate 19 provides the bulb and the receptacle with chip/spark shielding.

Returning now to FIGS. 1–4, secured between either the cover plate 17 and the top portion of the guard 12 (FIGS. 1 and 2) or between the shield plate 19 and the top portion of the guard 12 (FIG. 3) is a mounting bracket 20. Preferably, bracket 20 is secured to the plate 17 (FIGS. 1 and 2) or the top portion of the guard 12 by welding, nuts and bolts or any other suitable means. If desired, the bracket 20 may, alternatively be secured to portion 16 (FIGS. 1 and 2) or the plate 19 (FIG. 3).

Figure 4:
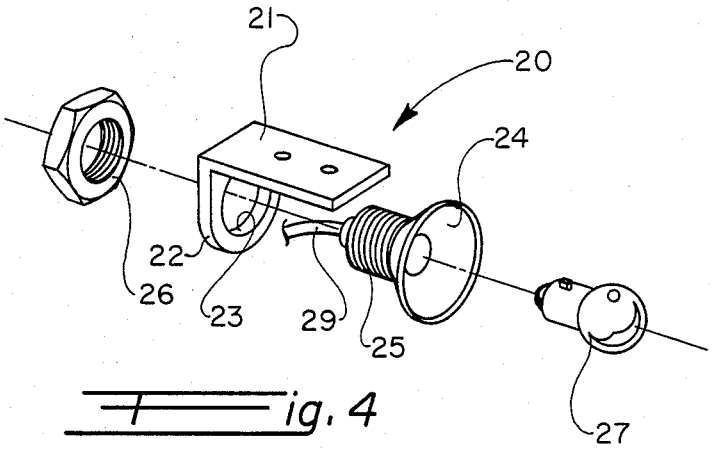
FIG. 4 is an exploded perspective view of the mounting means for carrying the light bulb receptacle of the present invention.

With particular reference now to FIG. 4, the means for carrying a light bulb receptacle, such that the receptacle is maintained in the pocket between the portion 16 and the plate 17 or 19 is seen.

The mounting bracket 20 includes a mounting arm 21 which is secured to the cover plate 17 (FIGS. 1 and 2) or the downwardly and outwardly inclined portion 16 (FIG. 3). The mounting arm 21 includes a first end which has a bracket portion 22 formed thereon and extending therefrom into the space (the clearance space) in the pocket. The bracket portion 22 has a bracket opening 23 formed therein.

A light bulb receptacle 24 having a rearward threaded portion 25 is received through the opening 23. When received through the opening 23, an internally threaded nut 26 threadably engages the rearward portion 25 being removably received thereon for removably securing the receptacle 24 to the mounting bracket 20. In this fashion, the bracket portion 22 holds the light bulb receptacle 24 therein in the pocket defined between the cover plate 21 and the guard 12 (FIGS. 1 and 2) or between the shield plate 19 and the guard 12 (FIG. 3).

A light bulb 27 is removably received in the receptacle 24, whereby the bulb 27 is electrically connected to the receptacle 24. Positioned in the pocket as described above, in FIGS. 1 and 2 the downwardly-inclined portion 16 provides a shield for the bulb 27, shielding the bulb 27 from chips and sparks that often results during the performance of work. Similarly, in FIG. 3 the shield 19 shields the bulb 27 form these sparks and chips.

In addition, the positioning of the portion of the cover plate 16 (FIGS. 1–3) and the shield 18 (FIGS. 1 and 2), 19 (FIG. 3) is such that light rays from the light bulb 27 are limited to an angle of approximately 90° or less.

Most importantly, positioned in the pocket as described above, the bulb 27 casts its light rays downwardly towards the tool rest and away from the eyes of the user.

It is also noted that, as described above the downwardly and outwardly inclined portion 16 (FIG. 3) or the shield portion of the cover plate 17 (FIGS. 1 and 2) provide a shield for shielding the user's eyes from these same sparks and chips.

Finally, means is provided for electrically connecting the light bulb receptacle 24 to a power source.

With reference to FIGS. 1 and 2, this means includes an opening 28 formed in the cover plate 17. An electrical cable 29 passes through the opening 28 in the cover plate 17 and is secured between the receptacle 24 and the power source. In this fashion, the cable 29 electrically connects the power source to the receptacle 24 and, hence, the bulb 27 carried thereby.

With reference to FIG. 3, this means includes an opening 28 formed in the downwardly and outwardly inclined portion 16 of the guard 12. An electrical cable 29 passes through the opening 28 and is secured between the receptacle 24 and the power source. In this fashion, the cable 29 electrically connects the power source to the receptacle 24, and hence, the bulb 27 carried thereby.

If desired, the cover plate 17, shield plate 19 an respective portions 16 can be formed so as to be substantially arcuate in shape. Such an arrangement provides a better definition to the pocket.

As described above, it can be seen that the cover plate 17 or the shield plate 19 and the mounting bracket 20 combination can be formed as a separate streamlined light accessory which could be secured to an existing bench grinder of the type described above.

Figure 5:
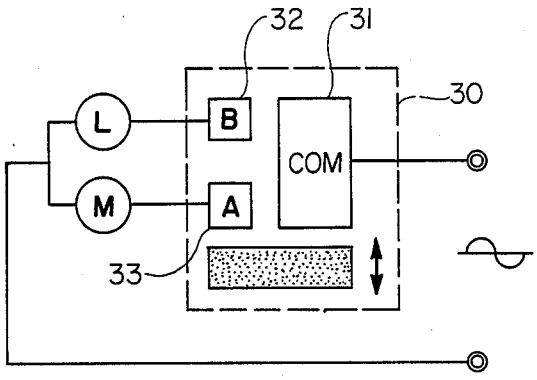
FIG. 5 is an electric circuit diagram of one embodiment of the electric circuitry of the present invention.

With reference now to FIG. 5, the light accessory of the present invention can be incorporated into the electric circuitry of the grinder, if desired. A three position slide button switch 30 is provided. A common contact point 31 is connected separately to the contact point of the motor of the bench grinder 32 and to a light accessory contact point 33.

The first position of the switch 30 is a completely disconnected position. This first position is the centrally located position. On either side of this first position are a second position which connects the common contact point 31 and the bench grinder motor contact point 32 and a third position which connects the common contact point 31, the bench grinder motor contact point 32 and the light accessory contact point 33. The switch 30 is moved between the first, second and third positions by a sliding action.

In the above fashion, only one electric switch and hence also only one power source is needed for both the light accessory and the bench grinder.

Figure 6:
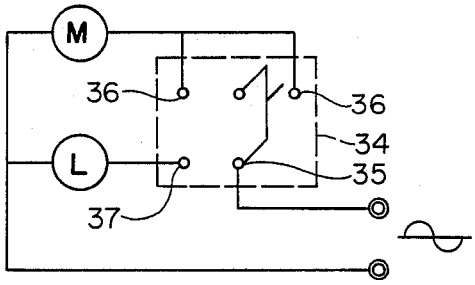
FIG. 6 is an electric circuit diagram of a second embodiment of the electric circuitry of the present invention.

With reference now to FIG. 6, another embodiment for incorporating the light accessory into the electric circuitry of the bench grinder is disclosed. In this embodiment, a three position double flip switch 34 is provided. A common contact point 35 is connected separately to the contact point 36 of the motor of a bench grinder and to a light accessory contact point 37.

The first position of the switch 34 is a completely disconnected position. This first position is the centrally located position. On either side of this first position are a second position which connects the common contact point 35 and the bench grinder contact point 36 and a third position which connects the common contact point 35 and the light accessory contact point 37 and the bench grinder contact point 36. The switch 34 is moved between the first, second and third position by a flipping or toggle action.

Once again, in the above fashion, only one electric switch and, hence, only one power source is needed for both the light accessory and the bench grinder.

Figure 7:
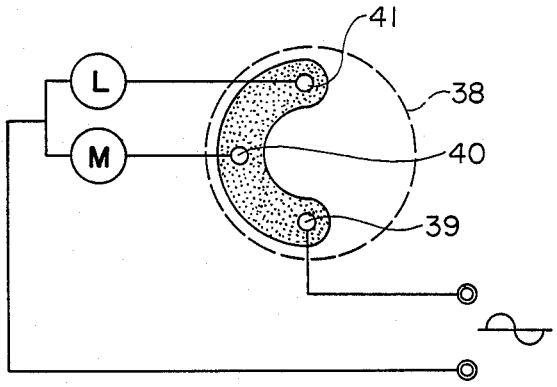
FIG. 7 is an electric circuit diagram of a third embodiment of the electric circuitry of the present invention.

With reference now to FIG. 7, still another embodiment for incorporating the light accessory into the electric circuitry of the bench grinder is disclosed. In this embodiment, a four position rotary turn switch 38 is provided. Three contact points 39, 40 and 41 are located on the locus of a circle being spaced 90° apart from each other (there being one empty position). A first contact point 39 is used to input electricity (the hot side). A second contact point 40 is connected to the bench grinder motor. A third contact point 41 connects the light accessory of the invention. The three contact points 39, 40 and 41 are able to communicate with an electric conductor that extends at least 150°. By circularly turning this conductor, the switch 38 may separately electrically contact any of the three contact points 39, 40 and 41 thereby electrically connecting, respectively both the bench grinder motor and the light accessory, the bench grinder motor alone or the lighting accessory alone. The empty position is an "off" position.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a bench grinder of the type having a motor-driven grinding wheel and further having an annular guard for the wheel, the guard having a top portion, an arcuate opening providing access to the wheel, and a tool rest on the guard for supporting the work being applied to the wheel, the improvement thereupon comprising the combination of:

a cover plate secured to the top portion of the guard substantially above the arcuate opening;

a light bulb receptacle;

means for mounting the receptacle between the guard and the cover plate; and a light bulb carried by the receptacle, said bulb being oriented such that the light bulb casts its rays downwardly toward the tool rest and away from the eyes of the user of the bench grinder.

2. The improvement of claim 1, wherein the means for mounting the receptacle between the guard and the cover plate is comprised of a mounting bracket secured between the cover plate and the top portion of the guard.

3. The improvement of claim 1, including means for electrically connecting the light bulb receptacle to a power source is comprised of:

a cover plate having an opening formed therein; and a cable passing through the opening in the cover plate, said cable secured between the receptacle and the power source, whereby the receptacle and the bulb carried by the receptacle are electrically connected to the power source.

4. The improvement of claim 2, wherein the mounting bracket is comprised of:

a mounting arm secured to the cover plate, said mounting arm having a first end; and said first end having a bracket portion formed thereon and extending therefrom, said bracket portion having an opening formed therein for receiving and holding the light bulb receptacle therein.

5. The improvement of claim 4, further comprised of:

the light bulb receptacle having a rearward threaded portion; and an internally threaded nut for threadably engaging the rearward threaded portion of the light bulb receptacle, such that when the receptacle is disposed through the opening formed in the bracket portion, the nut may be removably received thereon for removably securing the receptacle to the mounting bracket.

6. In a bench grinder of the type having a motor-driven grinding wheel and further having an annular guard for the wheel, the guard having a top portion, an arcuate opening providing access to the wheel, and a tool rest on the guard for supporting the work being applied to the wheel, the improvement thereupon comprising the combination of:

a cover plate secured to the top portion of the guard substantially above the arcuate opening in the guard;

a mounting bracket secured between the cover plate and the top portion of the guard;

a light bulb receptacle carried by the mounting bracket;

the cover plate having an opening formed therein;

means including a cable passing through the opening in the cover plate for electrical connection to the light bulb receptacle; and a light bulb carried by the receptacle, wherein the light bulb casts its light rays downwardly towards the tool rest and away from the eyes of the user of the bench grinder.

7. A streamlined light accessory for a bench grinder of the type having a motor-driven grinding wheel, an annular guard for the wheel, the guard having a top portion, an arcuate opening formed in the guard providing access to the wheel and a tool rest on the guard for supporting the work being applied to the wheel, said light accessory comprised of:

a cover plate;

means for securing the cover plate to the top portion of the guard substantially above the arcuate opening formed in the guard;

a light bulb receptacle;

means for mounting the receptacle between the guard and the cover plate;

a light bulb carried by the receptacle, wherein the light bulb casts its light rays downwardly towards the tool rest and away from the eyes of the user of the bench grinder; and means for electrically connecting the light bulb receptacle to a power source.

8. The streamlined light accessory of claim 7, wherein the means for mounting the receptacle between the guard and the cover plate is comprised of a mounting bracket secured between the cover plate and the top portion of the guard.

9. The streamlined light accessory of claim 7, wherein the means for electrically connecting the light bulb receptacle to a power source is comprised of:

an opening formed in the cover plate; and a cable passing through the opening in the cover plate, said cable secured between the receptacle and the power source, whereby the receptacle and the bulb carried by the receptacle are electrically connected to the power source.

10. The streamlined light accessory of claim 7, wherein the cover plate is substantially arcuate in shape.

11. The streamlined light accessory of claim 7, wherein the mounting bracket is comprised of:

a mounting arm secured to the cover plate, said mounting arm having a first end; and said first end having a bracket portion formed thereon and extending therefrom, said bracket portion having an opening formed therein for receiving and holding the light bulb receptacle therein.

12. The streamlined light accessory of claim 8, further comprised of:

the light bulb receptacle having a rearward threaded portion; and an internally threaded nut for threadably engaging the rearward threaded portion of the light bulb receptacle, such that when the receptacle is disposed through the opening formed in the bracket portion, the nut may be removably received thereon for removably securing the receptacle to the mounting bracket.

13. The streamlined light accessory of claim 7, wherein the cover plate further includes a shield portion extending over a portion of the opening formed in the guard, whereby chips and spark shielding is provided to the user.

14. A streamlined light accessory for a bench grinder of the type having a motor-driven grinding wheel, an annular guard for the wheel, the guard having a top portion, an arcuate opening formed in the guard providing access to the wheel and a tool rest on the guard for supporting the work being applied to the wheel, said light accessory comprised of:

a cover plate;

means for securing the cover plate to the top portion of the guard substantially above the arcuate opening formed in the guard;

a light bulb receptacle, the light bulb receptacle having a rearward threaded portion;

a mounting bracket secured between the cover plate and the top portion of the guard for mounting the receptacle between the guard and the cover plate, said mounting bracket including a mounting arm secured to the cover plate, said mounting arm having a first end, and said first end having a bracket portion formed thereon and extending therefrom, said bracket portion having an opening formed therein for receiving and holding the light bulb receptacle therein;

an internally threaded nut for threadably engaging the rearward threaded portion of the light bulb receptacle, such that when the receptacle is disposed through the opening formed in the bracket portion, the nut may be removably received thereon for removably securing the receptacle to the mounting bracket;

a light bulb carried by the receptacle, wherein the light bulb casts its light rays downwardly towards the tool rest and away from the eyes of the user of the bench grinder; and means for electrically connecting the light bulb receptacle to a power source.

15. A bench grinder, comprised of:

a motor-driven grinding wheel;

an annular guard for the grinding wheel, the annular guard having a top portion, the annular guard further having an arcuate opening formed therein providing access to the wheel;

a tool rest on the guard for supporting the work being applied to the wheel;

a cover plate secured to the top portion of the guard substantially above the arcuate opening in the guard;

a mounting bracket secured between the cover plate and the top portion of the guard;

a light bulb receptacle carried by the mounting bracket;

a light bulb carried by the receptacle;

means including a power source and an electrical cable secured between the receptacle and the power source, whereby the bulb carried by the receptacle is electrically connected to the power source; and wherein the light bulb casts its light rays downwardly towards the tool rest and away from the eyes of the user of the bench grinder.

16. The bench grinder of claim 15, further comprised of:

the top portion of the guard having a downwardly-inclined portion terminating at the opening of the guard;

the light bulb receptacle being carried by the mounting bracket between the cover plate and the downwardly inclined portion, whereby a chip and spark shield is provided to the light bulb carried by the light bulb receptacle.

17. The bench grinder of claim 16, further comprised of the cover plate being substantially arcuate in shape, said cover plate being secured to the guard over the downwardly-inclined portion, whereby a pocket is defined therebetween in which the light bulb receptacle having the light bulb therein is received.

18. A bench grinder, comprised of:

a motor-driven grinding wheel;

an annular guard for the grinding wheel, the annular guard having a top portion, the annular guard further having an arcuate opening formed therein providing access to the wheel;

a tool rest on the guard for supporting the work being applied to the wheel;

a cover plate secured to the top portion of the guard substantially above the arcuate opening in the guard;

a mounting bracket secured between the cover plate and the top portion of the guard;

a light bulb receptacle carried by the mounting bracket;

a light bulb carried by the receptacle;

the top portion of the guard having a downwardly-inclined portion terminating at the opening of the guard;

the light bulb receptacle being carried by the mounting bracket between the cover plate and the downwardly inclined portion, whereby a chip and spark shield is provided to the light bulb carried by the light bulb receptacle;

means including a power source and an electrical cable secured between the receptacle and the power source, whereby the bulb carried by the receptacle is electrically connected to the power source; and wherein the light bulb casts its light rays downwardly towards the tool rest and away from the eyes of the user of the bench grinder.

19. A bench grinder, comprised of:

a motor-driven grinding wheel;

an annular guard for the grinding wheel, said annular guard being positioned about the grinding wheel, whereby a clearance space is defined between the guard and the grinding wheel, the annular guard further having an arcuate opening formed therein providing access to the wheel;

a tool rest on the guard for supporting the work being applied to the wheel;

a mounting bracket secured between the top portion of the guard and the wheel and extending into the clearance space;

a light bulb receptacle carried by that portion of the mounting bracket extending into the clearance space;

a light bulb carried by the receptacle;

means including a power source and an electrical cable secured between the receptacle and the power source, whereby the bulb carried by the receptacle is electrically connected to the power source; and wherein the light bulb casts its light rays downwardly towards the tool rest and away from the eyes of the user of the bench grinder.

20. A bench grinder, comprised of:

a motor-driven grinding wheel;

an annular guard for the grinding wheel, said annular guard being positioned about the grinding wheel defining a clearance space therebetween, the annular guard having a top portion, the annular guard further having an arcuate opening formed therein providing access to the wheel, the top portion including a substantially downwardly and outwardly-inclined portion terminating at the opening of the guard;

a tool rest on the guard for supporting the work being applied to the wheel;

a downwardly-inclined shield plate secured to the guard and extending into the space between the downwardly and outwardly-inclined portion of the guard, whereby a pocket is defined therebetween;

a mounting bracket secured between the shield plate and the top portion of the guard;

a light bulb receptacle carried by the mounting bracket;

a light bulb carried by the receptacle;

the light bulb receptacle having the light bulb therein being received in the pocket, whereby the light carried by the light bulb receptacle is provided with a chip and spark shielding;

means including a power source and an electrical cable secured between the receptacle and the power source, whereby the bulb carried by the receptacle is electrically connected to the power source; and wherein the light bulb casts its light rays downwardly towards the tool rest and away from the eyes of the user of the bench grinder.

21. In a bench grinder having a motor-driven grinding wheel and further having an annular guard for the wheel; the guard having a top portion, an arcuate opening providing access to the wheel, and a tool rest on the guard for supporting the work being applied to the wheel; the combination of a cover plate secured to the top portion of the guard substantially above the arcuate opening in the guard, a mounting bracket secured between the cover plate and the top portion of the guard, a light bulb receptacle carried by the mounting bracket, the cover plate having an opening formed therein, means including a cable passing through the opening in the cover plate for electrical connection to the light bulb receptacle, and a light bulb carried by the receptacle, wherein the light bulb casts its light rays downwardly towards the tool rest and away from the eyes of the user of the bench grinder.

22. The bench grinder of claim 21, further comprised of:

the top portion of the guard having a downwardly-inclined portion terminating at the opening of the guard;

the light bulb receptacle being carried by the mounting bracket between the cover plate and the downwardly-inclined portion, whereby a chip and spark shield is provided to the light bulb carried by the light bulb receptacle; and the cover plate being substantially arcuate in shape, said cover plate being secured to the guard over the downwardly-inclined portion, whereby a pocket is defined therebetween in which the light bulb receptacle having the light bulb therein is received.

23. The bench grinder of claim 22, wherein the downwardly-inclined portion of that guard and the cover plate limit the angle of the light rays cast downwardly by the light bulb towards the tool rest and away from the eyes of the user of the bench grinder.

24. The apparatus of claim 21, further comprising a 3-position operator-selectable electrical switch comprising a common contact point, a contact point for the motor of the bench grinder, and a contact point for the light bulb; wherein in a first position of said 3-position switch no accessories are energized, in a second position of said switch the motor of the bench grinder is energized, and in a third position of said switch the motor of the bench grinder is energized and the light bulb is energized.

* * * * *